US006952842B2

(12) United States Patent
Courtney

(10) Patent No.: US 6,952,842 B2
(45) Date of Patent: Oct. 11, 2005

(54) TOILET SEAT FOR CHILDREN'S USE

(76) Inventor: Anthony Michael Courtney, 10 Acacia Grove, St. Neots, Huntingdonshire (GB), PE19 1HA ( * ) Notice: Subject to any disclaimer, the term of this patent is extended or adjusted under 35 U.S.C. 154(b) by 0 days.

(21) Appl. No.: 10/376,128

(22) Filed: Feb. 28, 2003

(65) Prior Publication Data

US 2003/0172448 A1 Sep. 18, 2003

Related U.S. Application Data

(63) Continuation of application No. PCT/GB01/03850, filed on Aug. 29, 2001.

(30) Foreign Application Priority Data

Sep. 2, 2000 (GB) ..... 0021546

(51) Int. Cl.[7] ..... A47K 13/00
(52) U.S. Cl. ..... 4/235; 4/236
(58) Field of Search ..... 16/247, 380, 381; 4/235, 234, 236, 237, 239, 240

(56) References Cited

U.S. PATENT DOCUMENTS

| | | | | | |
|---|---|---|---|---|---|
| 2,047,480 | A | * | 7/1936 | MacDonald | 4/234 |
| 4,175,315 | A | * | 11/1979 | Hayes et al. | 16/380 |
| 4,658,447 | A | * | 4/1987 | Smith | 4/236 |
| RE32,807 | E | * | 12/1988 | Adams | 4/235 |
| 5,363,509 | A | * | 11/1994 | Evans | 4/235 |
| 5,384,917 | A | * | 1/1995 | Epling | 4/235 |
| 6,189,159 | B1 | * | 2/2001 | Bailey et al. | 4/235 |

FOREIGN PATENT DOCUMENTS

WO WO 94/13185 * 6/1994

* cited by examiner

*Primary Examiner*—Khoa D. Huynh
(74) *Attorney, Agent, or Firm*—Heslin Rothenberg Farley & Mesiti P.C.

(57) ABSTRACT

A toilet seat assembly, useable by either an adult or a child, comprises a first adult-sized toilet seat, a second child-sized toilet seat, and a lid for the seats. Each of the first and second toilet seats and the lid is mounted separately to a hinge pin, which is itself mounted to the toilet bowl. The first toilet seat is mounted to the hinge pin at two points, one on each side of a point at which the second toilet seat is mounted.

18 Claims, 7 Drawing Sheets

TOILET SEAT FOR CHILDREN'S USE

CROSS-REFERENCE TO RELATED APPLICATION

This application is a continuation of PCT/GB01/03850 filed on Aug. 29, 2001 and published on Mar. 7, 2002, in English as International Application WO 02/17765 A1, and claims priority from GB 0021546.7 filed Sep. 2, 2000 (both of which applications are incorporated by reference herein).

BACKGROUND OF THE INVENTION

The present invention relates to seats for toilets. More particularly, it relates to a toilet seat which may safely and conveniently be used by adults and children.

A conventional toilet seat is dimensioned for the convenience of adult users. The dimensions of the seat and the aperture therein are too large for younger children, particularly those in the process of graduating from use of a potty. This is not safe and it does not encourage the child to make the transition to a conventional toilet.

It is known to provide an insert which may be fitted into the aperture in an adult=sized toilet seat and which has a seat and an aperture dimensioned to suit a small child. Such inserts have several shortcomings.

The insert may be removed from the adult-sized seat between uses. Storage space is required and the insert must be found and refitted before the next use, which frequently occurs at short notice.

Alternatively, the insert may be left in place. However, the insert is normally so large that it is not possible to balance the adult seat in an "up" position with safety. When the adult seat is in a "down" position, it is not possible to lower the lid of the conventional toilet seat assembly to the "down" position to cover both the adult seat and the insert. (Conventionally, the "down" position signifies that an element of a toilet seat assembly is resting substantially horizontally on the rim of the toilet bowl or on another element so resting, while the "up" position signifies that an element is disposed generally vertically, for example resting against the cistern of the toilet.)

Additionally, an adult, seeking to use a toilet with an insert left in place, must first remove the insert before the toilet is usable, which is inconvenient.

Inserts are also prone to move about, relative to the adult-sized seat and so catches or other locating mechanisms are frequently employed in the interests of safety. However, these increase the inconvenience of fitting and removing the insert.

It is known to provide a child's toilet seat, as part of a toilet seat assembly, for example by incorporating an aperture, coverable by a hatch or a flap, into the lid of a conventional toilet seat assembly. These are difficult to use and have achieved no apparent commercial success.

It is therefore an object of the present invention to provide a toilet seat assembly, compatible with existing toilet bowls, which may in alternative configurations be used by both adults and children and may be converted rapidly and safely between such configurations.

According to the present invention, there is provided a toilet seat assembly, adapted for use by either an adult or a child, comprising a first toilet seat unit, dimensioned to be usable by an adult, a second toilet seat unit, dimensioned to be usable by a child, a lid means for the seat units and hinge pin means mountable to a toilet bowl, wherein each of said first and second toilet seat units and said lid means is separately mounted pivotably to said hinge pin means, said first toilet seat unit being mounted to said hinge pin means at at least two points, disposed at least one on each side of a point at which said second toilet seat unit is mounted to the hinge pin means.

Preferably, said second toilet seat unit is so mounted to said hinge pin means that it may overlie said first toilet seat unit, and said lid means is so mounted to said hinge pin means that it may overlie both the first and the second toilet seat units.

Advantageously, the hinge pin means comprises a single continuous hinge pin.

Alternatively, the hinge pin means may comprise a pair of substantially collinear hinge pins each extending inwardly, from a respective point at which it is mounted to the toilet, towards the other.

The second toilet seat unit preferably comprises a generally annular seat with a single extension thereof disposed outwardly therefrom, said extension comprising aperture means at or adjacent its remote end to co-operate pivotably with said hinge pin means.

The aperture means of the second toilet seat unit may lie below the plane of the seat thereof, optionally being disposed within a zone of said single extension lying below said plane.

The aperture means of the second toilet seat unit may comprise at least one hinge arm adapted to co-operate pivotably with said hinge pin means and mounted to said single extension, optionally to an underside thereof.

The first toilet seat unit may comprise a generally annular seat.

The first toilet seat unit may further comprise a pair of substantially parallel arms extending outwardly from said seat, each said arm comprising aperture means at its remote end to co-operate pivotably with said hinge pin means.

The first toilet seat unit may comprise at least two hinge arms, adapted to co-operate pivotably with said hinge pin means, and optionally mounted to an underside of the seat of the first toilet seat unit.

The lid means may comprise a cover and a pair of arms, each said arm comprising aperture means at its remote end to co-operate pivotably with said hinge pin means.

The arms of the lid means may extend downwardly from a lower surface of the cover, such that each aperture means thereof lies below the plane of the cover.

Alternatively, the lid means may comprise a cover and a pair of hinge arms adapted to cooperate pivotably with said hinge pin means, optionally mounted to an underside of the cover.

In either case, the lid means may be mounted pivotably to the hinge pin means at two points disposed one on each side of a point at which the second toilet seat unit is mounted to the hinge pin means and optionally between said point at which the second toilet seat unit is mounted and a respective point at which the first toilet seat unit is mounted to the hinge pin means.

The lid means may comprise a rim, extending downwardly from the circumference of said cover, said rim being adapted, when the lid means is in the "down" position, to enclose said second toilet seat unit on each side and from above.

The lid means may be adapted to accommodate the second toilet seat unit when both are in the "up" position.

Catch means may be provided to maintain the second toilet seat unit in such an "up" accommodated disposition.

The lid means and the second toilet seat unit may, when in the "up" position, co-act as a back rest for a user of the first toilet seat.

In a preferred embodiment, the generally annular seat of the first toilet seat unit and the generally annular seat of the second toilet seat unit are generally concentric.

Advantageously, the generally annular seat of said second toilet seat unit comprises a downwardly extending rim around an inner circumference thereof.

Said rim may be adapted to co-operate with an inner circumference of the generally annular seat of the first toilet seat unit so as to locate the second toilet seat unit positively thereon.

Said rim may also be adapted to shield the first toilet seat unit from liquid splashed on to the seat of the second toilet seat unit.

The hinge pin means may be mounted to the toilet bowl via adjustable mountings to allow for differences in the separation between such points as are provided on the toilet bowl for said mountings.

Embodiments of the present invention will now be more particularly described, by way of example and with reference to the accompanying drawings, in which.

Figure 1:
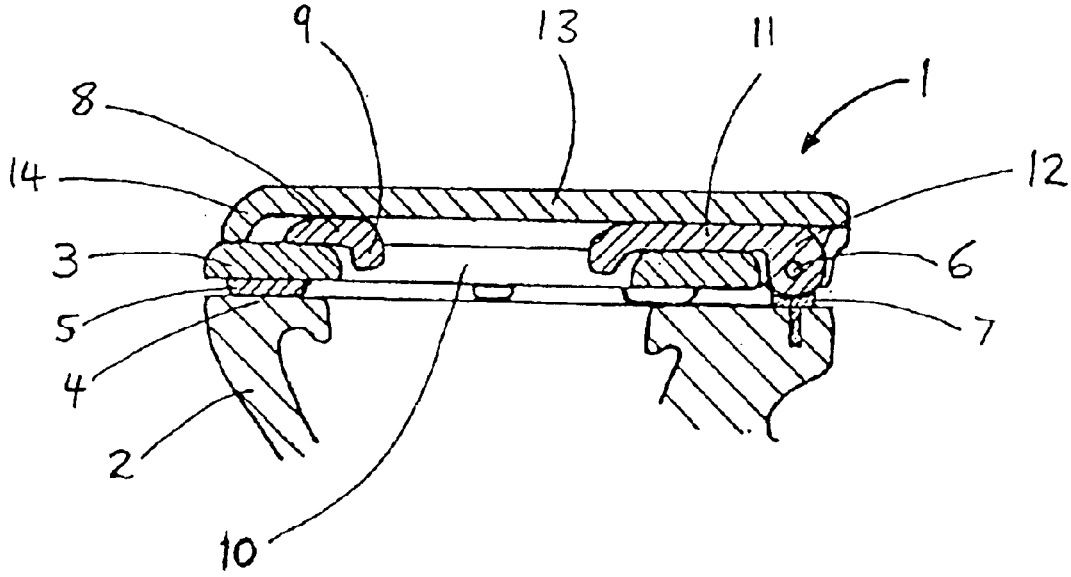
FIG. 1 is a cross-sectional view of a toilet seat assembly embodying the invention, in its "down" position on a toilet bowl.

Referring now to the drawings, and to FIG. 1 in particular, a toilet seat assembly 1 embodying the invention is mounted to a conventional toilet bowl 2. An adult-sized first toilet seat 3 rests on the upper rim 4 of the toilet bowl 2, supported by several stops 5 attached to the underside of the toilet seat 3. The toilet seat 3 has two short arms (not shown in this view) which each contain a hole configured to accept a horizontal hinge pin 6. The toilet seat 3 may thus be raised and lowered, pivoting about the hinge pin 6.

The hinge pin 6 is removably attached at each end to a mounting 7, which is fixed to the toilet bowl 2.

A child-sized second toilet seat 8 rests on the adult-sized toilet seat 3. An inner rim 9 extends downwardly from the inner circumference of the second seat 8 into an aperture 10 of the first toilet seat 3, helping to locate it positively, and guarding the first adult-sized toilet seat 3 from splashing by a user of the second child-sized toilet seat 8.

The second toilet seat 8 has a single arm 11 ending in a downward protrusion 12 which contains a hole configured to accept the hinge pin 6. The toilet seat 8 may thus be independently raised and lowered, pivoting about the hinge pin 6, provided that the first toilet seat 3 is "down".

A lid 13 rests on the first adult-sized toilet seat 3, supported by an outer rim 14 extending downwardly from the forward, and side parts of its outer periphery. The lid 13 and the outer rim 14 together enclose the second child-sized toilet seat 8. The lid 13 has a pair of short arms (not shown in this view), extending downwardly from its lower surface, each arm containing a hole configured to accept the hinge pin 6. The lid 13 may thus be raised and lowered, pivoting about the hinge pin 6, provided that both the toilet seats 3,8 are "down".

Figure 2:
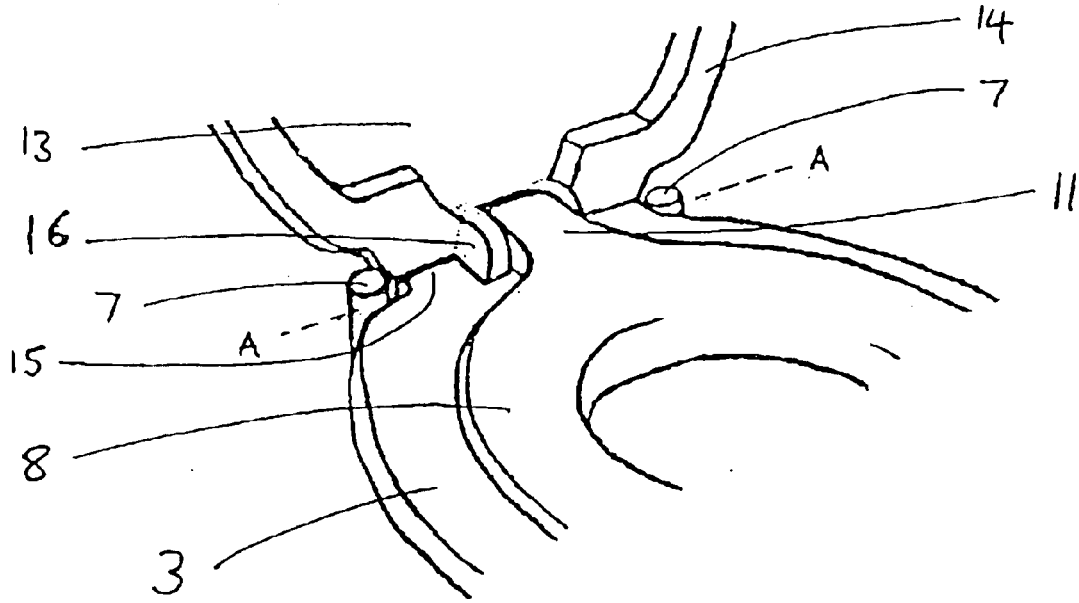
FIG. 2 is a scrap view of the hinge area of the toilet seat assembly shown in FIG. 1.

FIG. 2 shows the second child-sized toilet seat 8 resting on the first adult-sized toilet seat 3, with the lid 13 in its "up" position. The first toilet seat 3 has two short arms 15, the second toilet seat 8 has a single arm 11 and the lid 13 has two short arms 16. Each of the arms 11, 15 and 16 contains a hole therethrough, disposed coaxially along a line A—A. The hinge pin 6 (not visible in this view) passes through each of these holes, and is attached at each end to one of the two mountings 7.

The sizes and arrangement of the arms 11,15,16 on each part of the toilet seat assembly 1 are chosen in this embodiment for strength, durability and stability. The first adult-sized seat 3 bears the greatest loads in use, so has two relatively broad arms 15. The child-sized seat 8 is also load bearing in use, so has a relatively broad arm 11. The lid 13 supports little load and is in any event supported by its rim 14, and so the arms 16 may be relatively narrow. The arrangement shown, in which the arms 11,15,16 enclose the whole length of the hinge pin 6, and the arms 16 are disposed between each arm 15 and the arm 11, is found to give the greatest stability of each part of the assembly 1 relative to each other and to the toilet bowl 2.

Referring now to FIGS. 3 to 6, the toilet seat assembly has four configurations.

Figure 3:
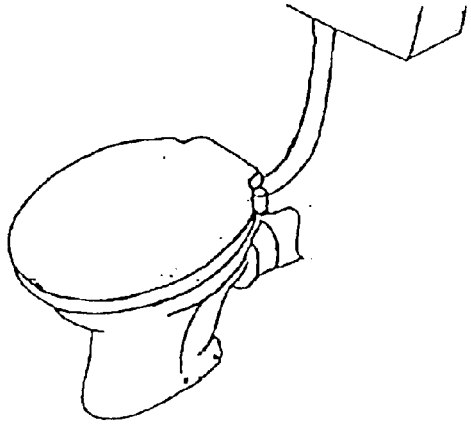
FIGS. 3 to 6 show the configurations adoptable by the toilet seat assembly of FIG. 1.

In FIG. 3 each part is down, and the lid covers both seats.

Figure 4:
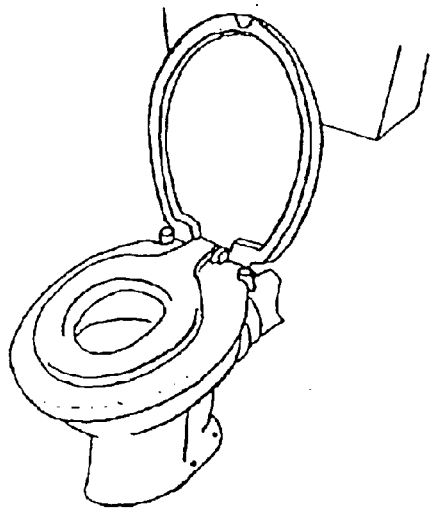

In FIG. 4, the lid is up and the child-sized seat, resting stably on the adult-sized seat, is available for use by a child.

Figure 5:
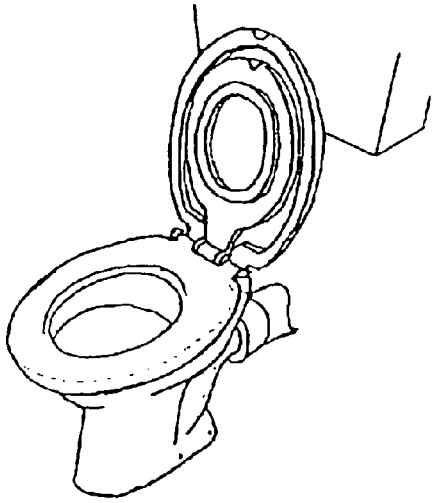

In FIG. 5, the lid and the child-sized seat are up and the adult-sized seat is available for use by an adult. The child-sized seat is disposed within the lid and together they make up a backrest for a user of the adult seat.

Figure 6:
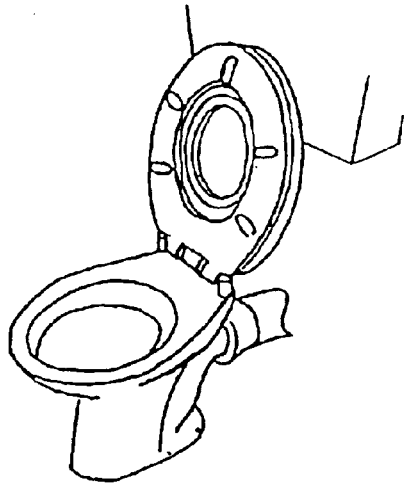

In FIG. 6, both seats and the lid are up and the toilet bowl is directly accessible.

The hinge configuration ensures that any or all of the parts of the toilet seat assembly may be placed stably in the "up" position. Even when oriented substantially vertically, the centre of gravity of each part lies on the side of a vertical plane through the hinge remote from the toilet bowl, so there is no tendency for it to topple back.

The child-sized toilet seat may thus be put in place for use and removed again, safely and rapidly. It has been found that even young children can grasp this procedure and perform it reliably without close supervision. Once the child has grown to be able to use the adult-sized seat, the child-sized seat may be removed by detaching one mounting, withdrawing the hinge pin, lifting off the child-sized seat and reassembling the remainder of the assembly. Removal of the single central arm on the child-sized seat leaves the remaining arms still so arranged on the hinge pin that they are unable to slide along it, and the assembly thus remains stable.

An adult user of the assembly has a convenient backrest, comprising the lid and the child-sized seat. Should a user of the child-sized seat splash the toilet seat assembly, only the child-sized seat will need to be cleaned since the adult-sized seat is protected by the inner rim 9.

Figure 7:
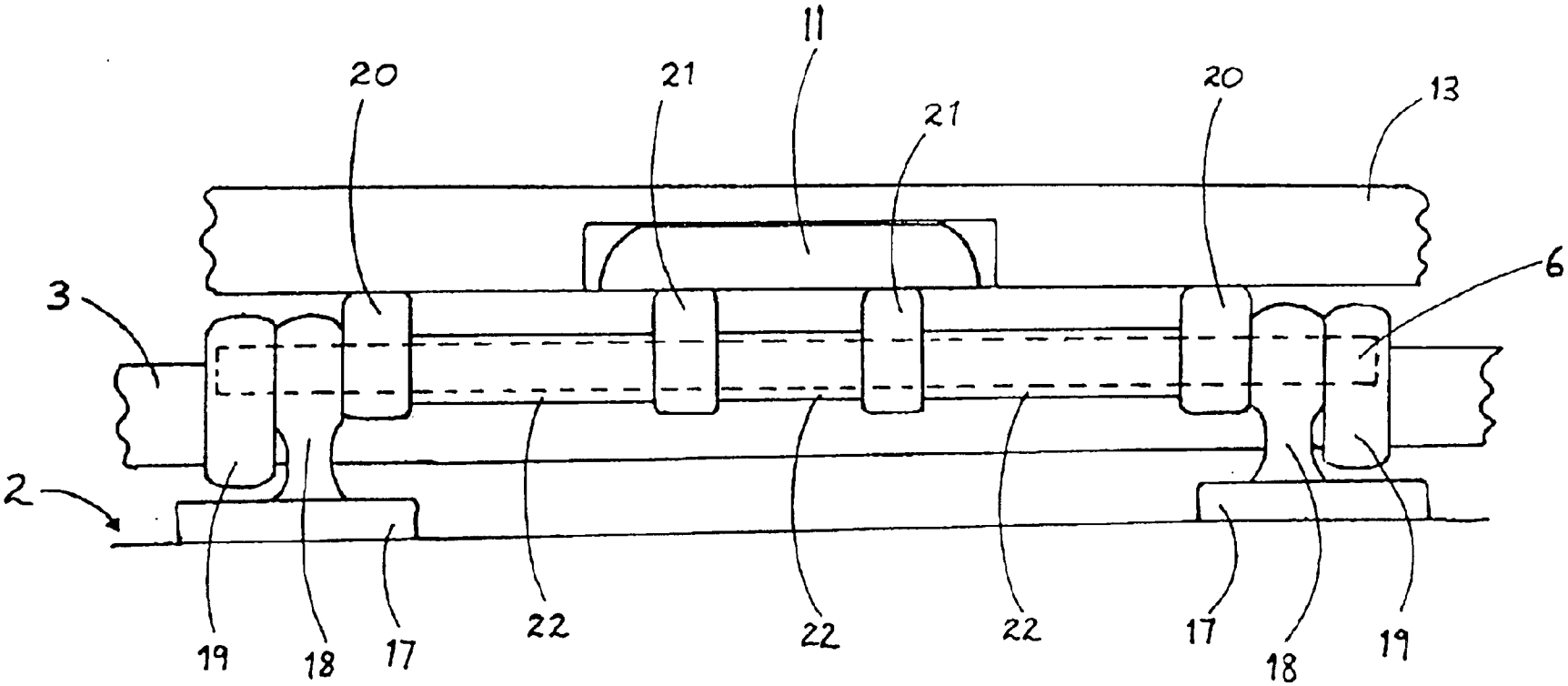
FIG. 7 is a scrap view of the hinge area of another toilet seat assembly embodying the invention, in its "down" position, viewed from a direction remote from the seats thereof.

An alternative hinge arrangement is shown in FIG. 7. A first adult-sized toilet seat 3, a second child-sized toilet seat 8 and a lid 13 are all shown in the "down" position. (Note: only a rearwardly-extending single arm 11 is visible of the second toilet seat 8 in this view, and the single arm 11 is not, in this embodiment, provided with a downward protrusion 12).

Two hinge fixing components 17 are mounted to the toilet bowl 2, each having a hinge support post 18 extending substantially vertically therefrom. The hinge fixing components 17 are mounted to holes in the toilet bowl 2 provided therefor, normally with nut and bolt fittings. The distance between the holes in the toilet bowl 2 can vary appreciably, and so the hinge fixing components 17 are adjustable to permit a substantially constant separation to be maintained between the two hinge support posts 18. Each hinge support post 18 has an aperture therethrough, configured to accept the hinge pin 6 (the position of which is indicated by dotted lines).

The hinge pin 6 has, in all, six hinge arms mounted pivotably thereto. Each of a pair of outer, lower hinge arms 19, is attached to a lower surface of the first adult-sized toilet seat 3. Each of a pair of outer, upper hinge arms 20 is attached to a lower surface of the lid 13, and each of a pair of inner, upper hinge arms 21 is attached to a lower surface of the single arm 11 of the second child-sized toilet seat 8. Each hinge arm 19,20,21 is preferably attached to its respective toilet seat or lid with screw fittings. Each upper hinge arm 20,21 is provided with an aperture therethrough, configured to accept the hinge pin 6, while the outer, lower hinge arms 19 have recesses therein to accept ends of the hinge pin 6. The hinge pin 6 thus has minimal freedom to move axially, relative to the hinge arms 19,20,21 and the posts 18, but pivoting movements are not restricted.

Three spacing tubes 22 are disposed concentrically about the hinge pin 6, one extending between each outer, upper hinge arm 20 and a respective neighbouring inner, upper hinge arm 21, and one extending between the two inner, upper hinge arms 21. The spacing tubes 22 prevent significant movement of the inner, upper hinge arms 21 (and hence of the second toilet seat 8) along the axis of the hinge pin 6, and so maintain the two toilet seats 3,8 and the lid 13 in alignment, one with another. The spacing tubes 22 may also improve the aesthetic appearance of the hinge arrangement.

This particular hinge arrangement also renders it easier to maintain a required separation between an upper surface of the first adult-sized toilet seat 3 and a lower surface of the second child-sized toilet seat 8 and/or the lid 13, when each is in its respective "down" position. A minimum clearance therebetween is frequently specified on safety grounds, so that a user's fingers cannot easily be trapped beneath a falling lid or second toilet seat.

Figure 8:
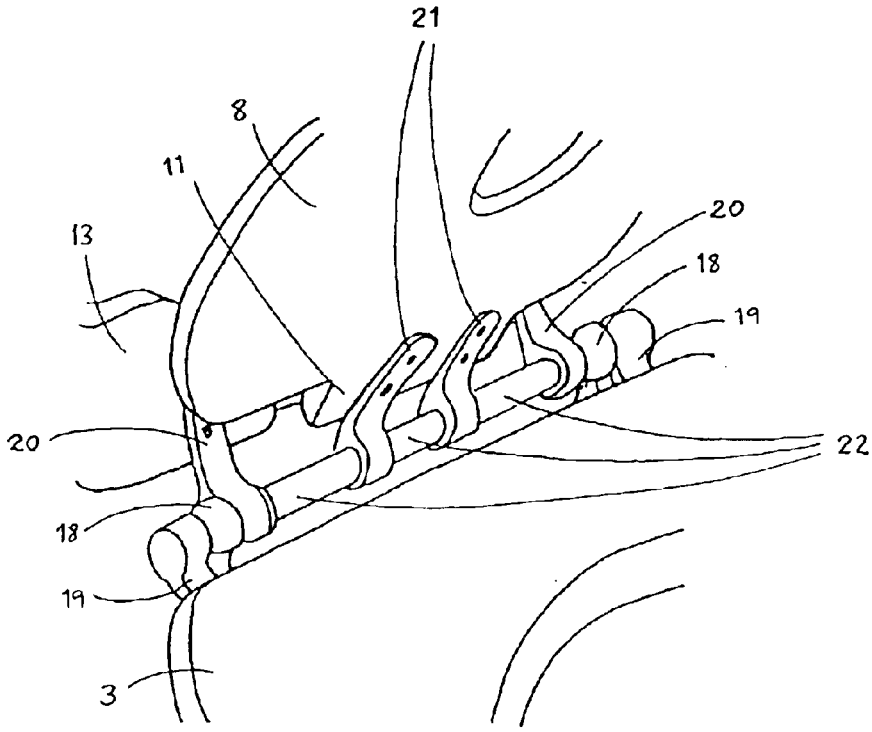
FIGS. 8 and 9 are two further scrap views of the hinge area of the toilet seat assembly of FIG. 7, in two further configurations.

FIG. 8 shows the hinge assembly of FIG. 7 in operation, in a configuration in which the first toilet seat 3 is in a "down" position, the lid 13 is in an "up" position, and the second toilet seat 8 is in an intermediate position, for example while in the process of being raised or lowered.

Figure 9:
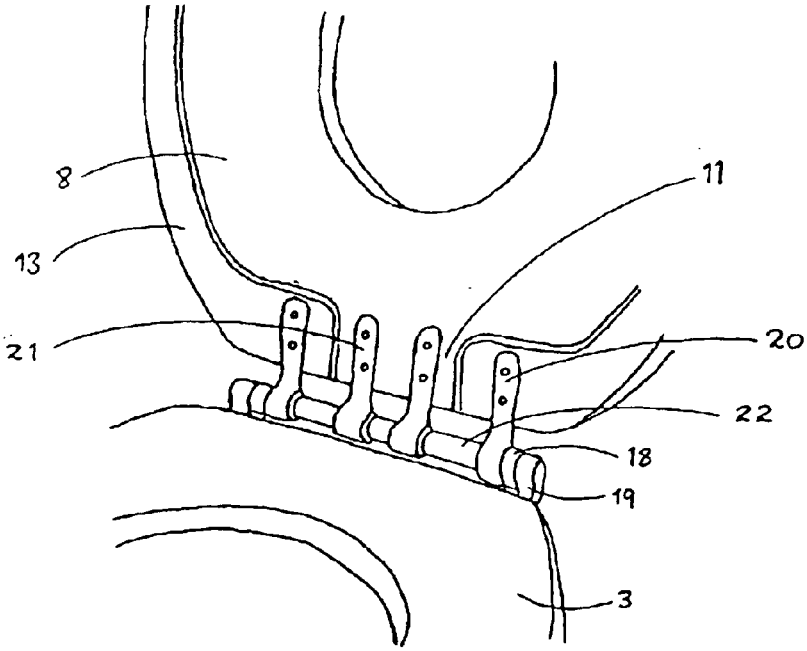
Figure 10:
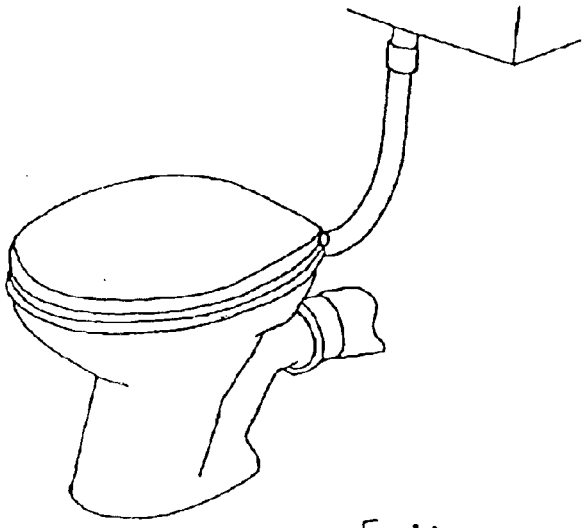
FIGS. 10 to 13 show the configurations adoptable by the toilet seat assembly of FIG. 7.
Figure 11:
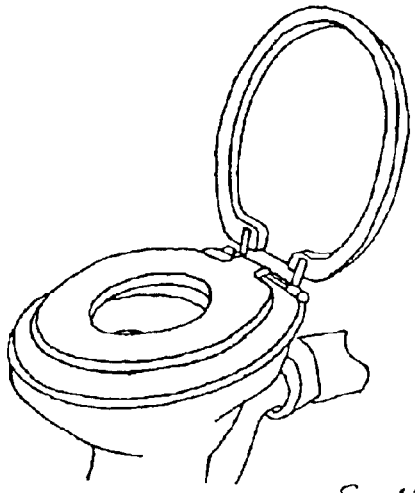
Figure 12:
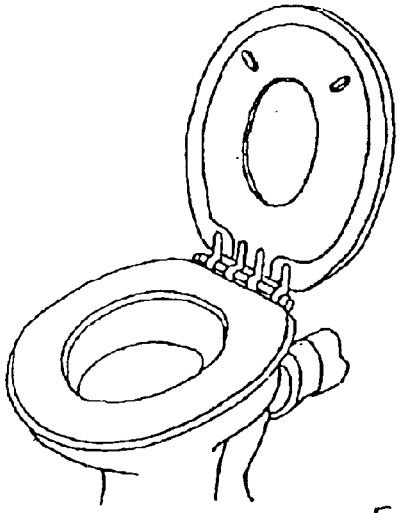
Figure 13:
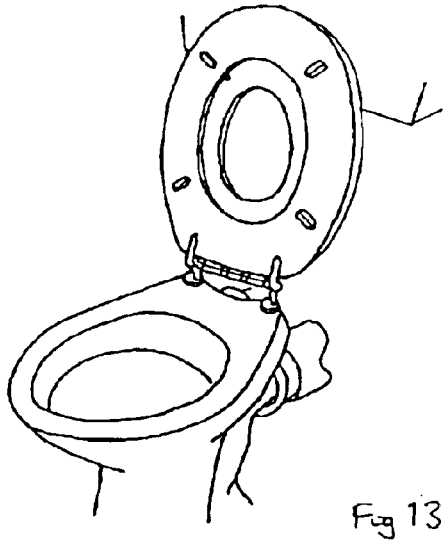

FIG. 9 shows the first toilet seat 3 in a "down" position and both the lid 13 and the second toilet seat 8 in an "up" position. As well as demonstrating the operation of the hinge assembly of FIG. 7, this also shows the second toilet seat 8 of this embodiment fitting conformably within the lid 13, such that the seat 8 and the lid 13 together present a substantially planar surface to, for example, a back of a user of the first toilet seat 3.

Referring now to FIGS. 10 to 13, four configurations are shown of a toilet seat assembly provided with the hinge assembly of FIG. 7, corresponding to the four configurations shown in FIGS. 3 to 6 respectively.

Figure 14:
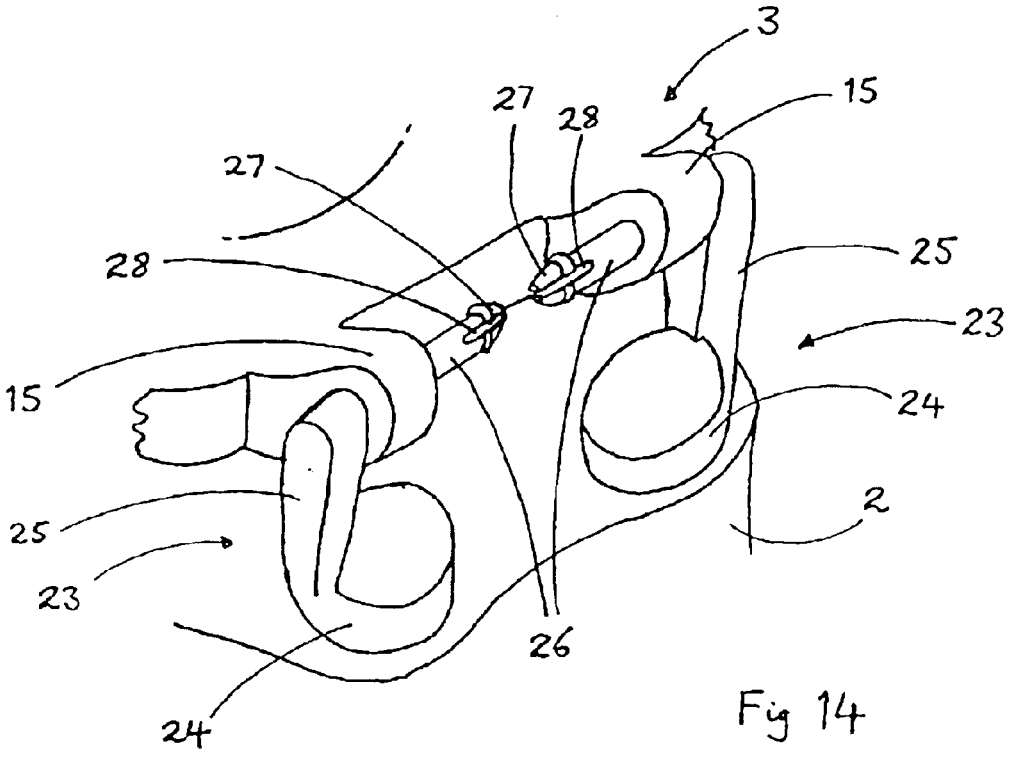
FIG. 14 shows in partially assembled form the hinge area of a third toilet seat assembly embodying the invention.
Figure 15:
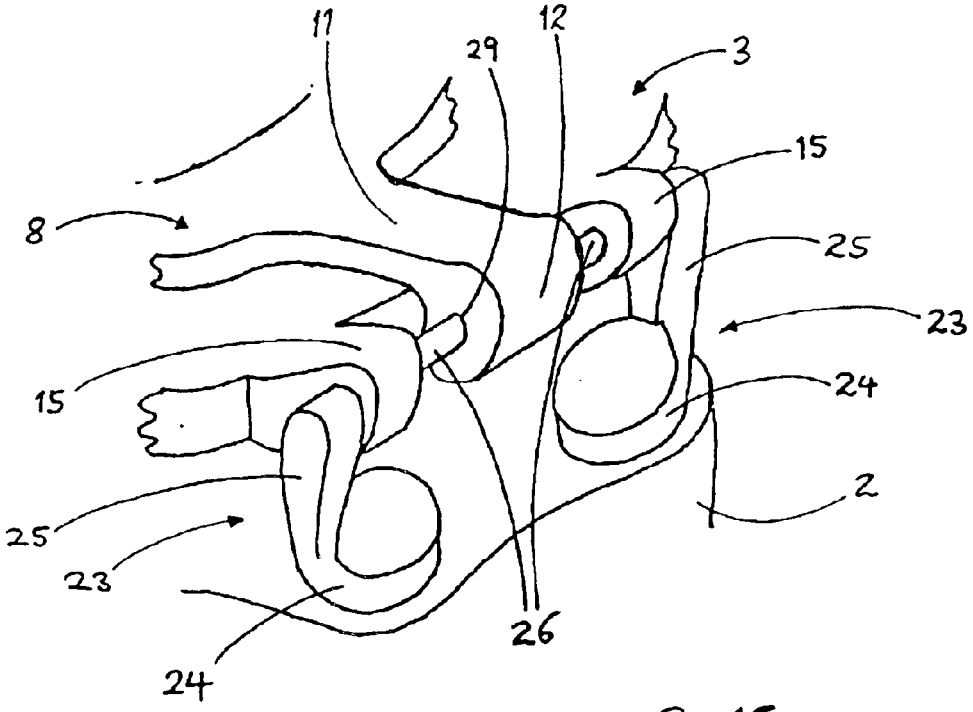
FIG. 15 shows the hinge area of the toilet seat assembly of FIG. 14 with a second toilet seat fitted thereto.

A third embodiment of the invention, shown in FIGS. 14 and 15, is particularly suited for use when components of the toilet seat assembly are to be made from plastics materials, and especially when they are formed as substantially hollow mouldings. A pair of short hinge pins 26 is used in place of the single hinge pin 6 of the toilet seat assemblies of FIGS. 1 to 13.

FIG. 14 shows a toilet seat assembly mounted to a toilet bowl in partially assembled form. In practice, the toilet seat assembly would be more conveniently fitted together before mounting to the toilet bowl, but this view shows more clearly the details of this embodiment. Two hinge fixtures 23 each comprise a fixture base 24, bolted to the toilet bowl 2, and a hinge support post 25 extending generally vertically in use from the fixture base 24. A short hinge pin 26 extends generally horizontally away from an upper part of each post 25. Each hinge pin 26 is provided with a locating head 27 at an end of the hinge pin 26 remote from the respective post 25. Each locating head 27 is of slightly greater diameter than the respective hinge pin 26, and has a transverse slot 28 extending therethrough.

The hinge fixtures 23 are so mounted to the toilet bowl 2 that the hinge pins 26 extend inwardly one towards the other and are aligned substantially collinearly. One hinge pin 26 passes through a respective hole in each short arm 15 of a first adult-sized toilet seat 3, enabling the adult-sized seat to be raised and lowered, pivoting about the hinge pins 26. A lid 13 may be mounted to the hinge pins 26 in a similar manner, but in this view is omitted for clarity.

FIG. 15 shows the toilet seat assembly of FIG. 14 with a second child-sized toilet seat 8 also fitted into place. The second toilet seat 8 has a single arm 11 ending in a downward protrusion 12, which protrusion 12 is provided with two holes 29, each configured to accept a respective hinge pin 26 (one said hole is concealed in this view). Each hole 29 connects with an interior of the hollow moulded downward protrusion 12.

The second child-sized toilet seat 8 may thus rest on top of the first adult-sized toilet seat 3, when the first toilet seat 3 is in its "down" position, and may itself be raised and lowered, pivoting about the hinge pins 26, without risk of coming loose therefrom.

If it is desired to remove the second child-sized toilet seat 8 from the toilet seat assembly, the hinge fixtures 23 are either completely removed from the toilet bowl 2, or they are loosened sufficiently to allow the hinge pins 26 to be urged one away from the other. Each hinge pin 26 in turn may then be withdrawn from the respective hole 29 in the downward protrusion 12 with sufficient manually-exerted force to overcome the resistance of the respective locating head 27. The second toilet seat 8 may be removed and the remainder of the toilet seat assembly may be remounted to the toilet bowl 2.

Optionally, in the absence of the second toilet seat, a tubular member (not shown) may be fitted, concentrically extending over both hinge pins 26, to ensure that the hinge pins 26 remain stably in alignment one with the other, and for aesthetic purposes.

Figure 16:
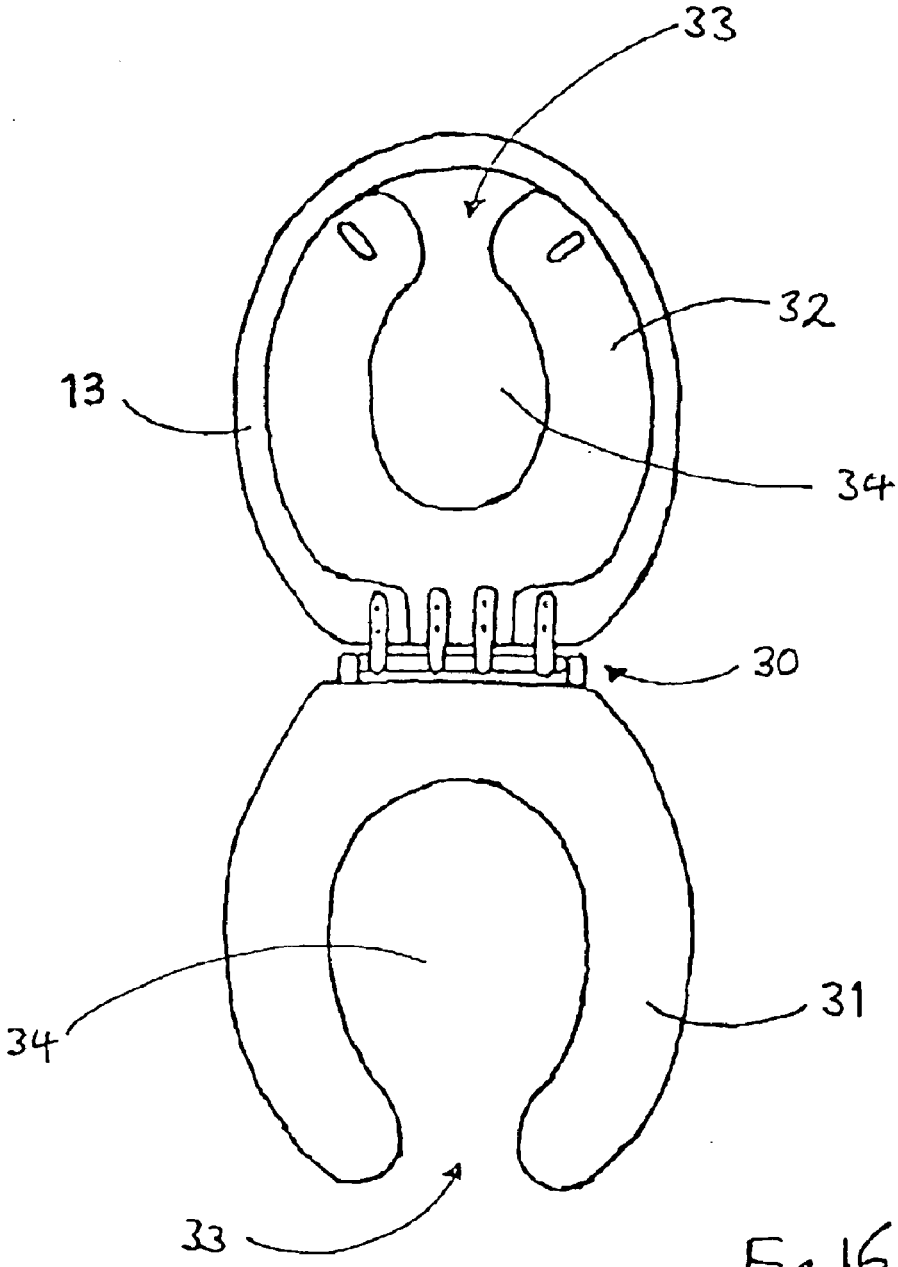
FIG. 16 shows a fourth embodiment of the invention, provided with toilet seats of an alternative shape.

Referring now to FIG. 16, an embodiment of the invention is shown in which the toilet seats of the toilet seat assembly are not continuously annular. A hinge assembly 30 is shown of the type shown in FIG. 7 above, although the hinge assemblies of FIG. 1 and FIG. 14 are also usable in this embodiment. The various components of the toilet seat assembly are here shown as if laid out on a flat surface, for clarity, and not as they would appear in position on a toilet bowl.

In certain situations, notably in hospitals or in other medical premises, it is normal to employ toilet seats that are not continuously annular, but instead have a gap at the front, as viewed by a user thereof. A first, adult-sized "horseshoe"-shaped toilet seat 31 and a second, child-sized "horseshoe"-shaped toilet seat 32 are therefore used in this embodiment, in place of the first toilet seat 3 and the second toilet seat 8, respectively. The lid 13, the hinge assembly 30, and its method of attachment may be of any desired type as described or shown above.

The term "annular" as used throughout this specification should therefore be understood to comprise both continuously annular, with a discrete generally central enclosed opening, and discontinuously annular, for example as shown with a gap 33 in the seat connecting a generally central opening 34 to an exterior of the annulus.

What is claimed is:

1. A toilet seat assembly adapted for use by either an adult or a child, comprising a first toilet seat unit dimensioned to be usable by an adult, a second toilet seat unit dimensioned to be usable by a child, a lid for the seat units, a hinge pin and means to mount the hinge pin to a toilet bowl, wherein each of said first and second toilet seat units and said lid is separately mounted pivotably to said hinge pin, said first toilet seat unit being mounted to said hinge pin at two points disposed one on each side of a point at which said second toilet seat unit is mounted to the hinge pin, and means associated with said hinge pin for inhibiting lateral movement in use of said second toilet seat unit along said hinge pin, said lateral movement inhibiting means comprising spacing tubes positioned along said hinge pin, separately from any of said toilet seat units, lid and means for mounting.

2. An assembly according to claim 1, wherein said second toilet seat unit is so mounted to said hinge pin that it may overlie said first toilet seat unit, and said lid is so mounted to said hinge pin that it may overlie both the first and the second toilet seat units.

3. An assembly according to claim 1, wherein the second toilet seat unit comprises a generally annular seat with a single extension thereof disposed outwardly therefrom, said extension having an aperture adjacent a remote end of the extension to co-operate pivotably with said hinge pin.

4. An assembly according to claim 3, wherein the aperture of the second toilet seat unit lies below a plane of a seat of said second toilet seat unit.

5. An assembly according to claim 4, wherein said aperture means is disposed within a zone of said single extension lying below said plane.

6. An assembly according to claim 3, wherein the second toilet seat unit comprises a pair of hinge arms adapted to co-operate pivotably with said hinge pin and mounted to said single extension.

7. An assembly according to claim 6, wherein each hinge arm is mounted to an underside of said single extension.

8. An assembly according to claim 1, wherein the first toilet seat unit comprises a generally annular seat and a first pair of substantially parallel arms extending outwardly therefrom, each said arm having an aperture adjacent its remote end to co-operate pivotably with said hinge pin.

9. An assembly according to claim 1, wherein the first toilet seat unit comprises two hinge arms, adapted to co-operate pivotably with said hinge pin.

10. An assembly according to claim 9, wherein said two hinge arms are mounted to an underside of a seat of the first toilet seat unit.

11. An assembly according to claim 1, wherein the lid comprises a cover and a rim extending downwardly from a circumference of the cover and adapted, when the lid is in a "down" position, to enclose said second toilet seat unit on each side and from above.

12. An assembly according to claim 11, wherein the lid is adapted to accommodate the second toilet seat unit when both are in an "up" position.

13. An assembly according to claim 1, wherein the lid comprises a pair of arms, each arm having an aperture adjacent its remote end to co-operate pivotably with said hinge pin.

14. An assembly according to claim 13, wherein the lid is mounted pivotably to the hinge pin at two points disposed one on each side of a point at which the second toilet seat unit is mounted to the hinge pin.

15. An assembly according to claim 14, wherein the lid is mounted pivotally to the hinge pin at a point between said point at which the second toilet seat unit is mounted and a respective point at which the first toilet seat unit is mounted to the hinge pin.

16. An assembly according to claim 1, wherein a generally annular seat of the first toilet seat unit and a generally annular seat of the second toilet seat unit are generally concentric.

17. An assembly according to claim 16, wherein the generally annular seat of said second toilet seat unit comprises a downwardly extending rim around an inner circumference thereof.

18. An assembly according to claim 17, wherein said rim is adapted to cooperate with an inner circumference of the generally annular seat of the first toilet seat unit so as to locate the second toilet seat unit positively thereon.

* * * * *